United States Patent [19]

Miller et al.

[11] 4,445,719

[45] May 1, 1984

[54] RELEASE MECHANISM FOR A CYLINDRICAL OBJECT RECOVERY DEVICE

[75] Inventors: Donald Miller, Del Mar; Clark A. Bowers, San Diego, both of Calif.

[73] Assignee: The United States of America as represented by the Secretary of the Navy, Washington, D.C.

[21] Appl. No.: 298,712

[22] Filed: Sep. 2, 1981

[51] Int. Cl.[3] ..... B66C 1/66

[52] U.S. Cl. ..... 294/88; 294/86 R; 294/66 R

[58] Field of Search ..... 294/88, 86 R, 83 R, 294/66 R, 103, 113, 86 A, 90, 93, 94, 95, 116

[56] References Cited

U.S. PATENT DOCUMENTS 3,722,941 3/1973 Seiple et al. ..... 294/86 R 3,795,420 3/1974 Preston, Jr. ..... 294/88

*Primary Examiner*—James B. Marbert

*Attorney, Agent, or Firm*—Robert F. Beers; Ervin F. Johnston

[57] ABSTRACT

A release mechanism is provided for a structural member, such as a cylindrical object recovery device, wherein the structural member has top and bottom sides. The release mechanism includes a block which is attachable to the structural member so as to extend thereabove. A piston is mounted in the block and is moveable vertically between up and down positions. At least one rod is connected to the piston and extends vertically downwardly beyond the bottom side of the structural member so as to be capable of moving the piston to the upward position when forcibly engaged by the object. A U-shaped holder is fitted over the block with each leg of the holder having a recess. A pair of pistons is laterally mounted in the U-shaped block in an opposing relationship, and each piston is moveable between inward and outward positions. Each lateral piston is engageable with the holder within the holder recess in the outward position so as to retain the U-shaped holder to the block, and each lateral piston clears the respective holder recess in the inward position so as to release the U-shaped holder from the block. A rod is connected to each lateral piston and extends inwardly within the block for engagement and disengagement with the vertical piston as the vertical piston moves from its down position to its up position. A spring arrangement is provided for biasing each lateral piston toward the inward position. Each rod maintains the respective lateral piston in its outward holder engaging position when the lateral piston rod is in engagement with the vertical piston. Further, each rod allows the respective lateral piston to be spring biased to its inward disengaged position with respect to the holder when the lateral piston rod is disengaged from the vertical piston. With this arrangement forcible engagement of the bottom of the vertical rod with the cylindrical object will cause the vertical piston to move upwardly and allow the lateral pistons to move inwardly to release the U-shaped holder from the block and the structural member.

8 Claims, 10 Drawing Figures

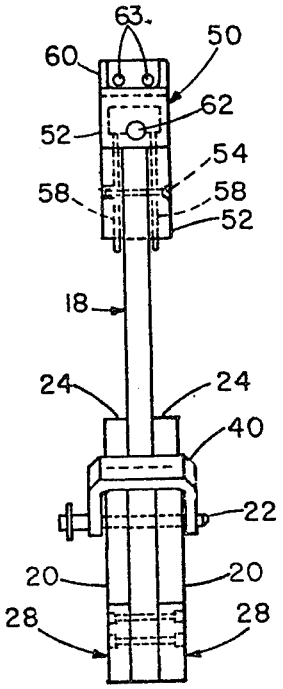
FIG. 3
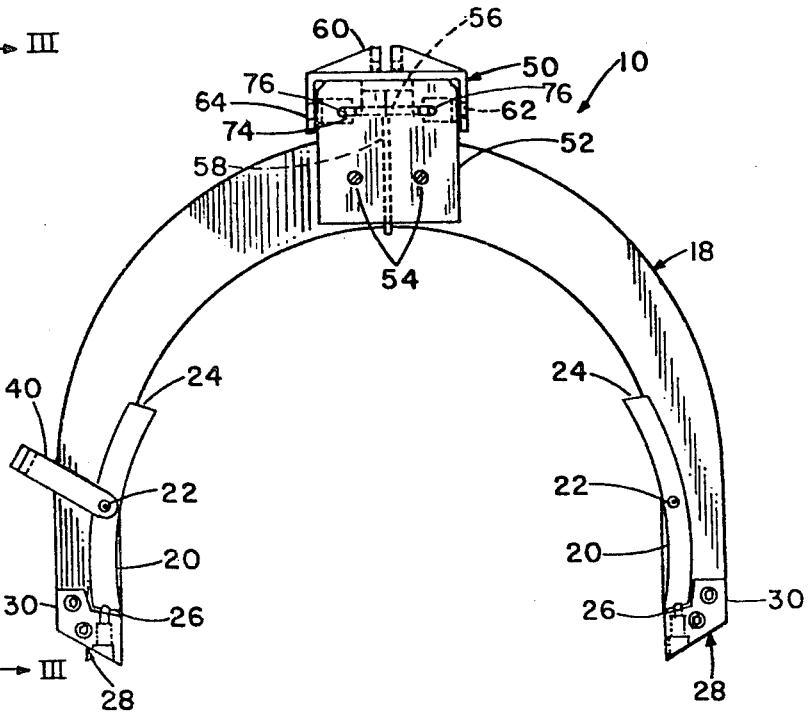
FIG. 2 (RELEASING POSITION)
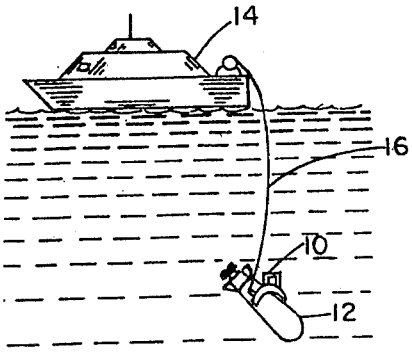
FIG. 1
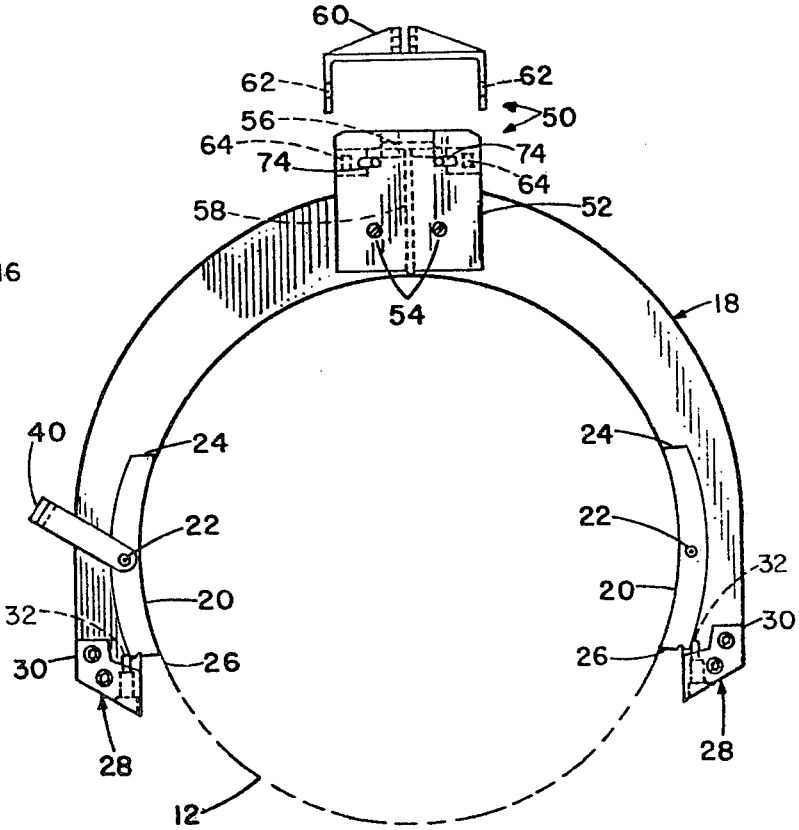
FIG. 4 (GRABBING POSITION)

RELEASE MECHANISM FOR A CYLINDRICAL OBJECT RECOVERY DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The U.S. Navy is heavily involved in ocean salvage operations, particularly the retrieval of practice torpedoes which find themselves residing on the ocean floor. The present method employed by the U.S. Navy for recovery of practice torpedoes is to utilize a tethered underwater vehicle which can be remotely operated by an operator on a surface ship utilizing television techniques. The underwater vehicle has manipulator arms which can be utilized by the operator to grab the torpedo for lift purposes. This retrieval method has been quite effective, however, it is a complex operation requiring a considerable amount of equipment and manpower.

There is a need for a recovery apparatus which is simpler to operate, and which is compatible with various methods of deployment, such as by either a manned or unmanned underwater vehicle. Also, it would be desirable to obtain a recovery apparatus which is considerably smaller in size and lighter in weight.

SUMMARY OF THE INVENTION

The present invention is a release mechanism for a recovery apparatus which makes the recovery apparatus compatible and practical for use on either a manned or unmanned underwater vehicle. This is accomplished by providing the release mechanism with a block which is attachable to the recovery apparatus in such a manner so as to extend thereabove. A piston is mounted in the block and is movable vertically between up and down positions. At least one rod is connected to the piston and extends vertically downwardly beyond a bottom side of the recovery apparatus so as to be capable of moving the piston to the upward position when forcibly engaged by the object. A U-shaped holder is fitted over the block with each leg of the holder having a recess. A pair of pistons is laterally mounted in the U-shaped block in an opposing relationship, and each piston is moveable between inward and outward positions. The lateral pistons are engageable with the holder within the holder recesses in the outward positions for retaining the U-shaped holder to the block, and the pistons clear the holder recesses in the inward positions so as to release the U-shaped holder from the block.

A rod is connected to each lateral piston and extends inwardly for engagement and disengagement with the edge of the vertical piston as the vertical piston moves from its down position to its up position. A spring apparatus is provided for biasing each lateral piston toward the inward position. Each rod maintains the respective lateral piston in its outward holder engaging position when the lateral piston rod is in engagement with the vertical piston. Further, each rod allows the lateral piston to be spring biased to its inward disengaged position with respect to the holder when the lateral piston rod is disengaged from the vertical piston. With this arrangement the vertical rod will move the vertical piston upwardly when the vertical rod is forcibly engaged by the cylindrical object so as to allow the lateral pistons to move inwardly and release the U-shaped holder from the block and the recovery apparatus.

OBJECTS OF THE INVENTION

An object of the present invention is to overcome the problems associated with prior art recovery apparatus release mechanisms.

Another object is to provide a release mechanism which is operated automatically by the forcible engagement of an object with a rod of the mechanism.

A further object is to provide a release mechanism which can be attached to a structural member, and which can be easily cocked to a locked position, after which simple forcible engagement of an object with a rod of the mechanism will simultaneously unlock and release the mechanism.

Still another object is to provide a release mechanism which is attachable to a U-shaped recovery apparatus and which is compatible with several deployment vehicles.

Yet another object is to provide a push operated release mechanism which is smaller, lighter in weight, and more efficient to operate.

Other objects, advantages and novel features of the invention will become apparent from the following detailed description of the invention when considered in conjunction with the accompanying drawings.

BRIEF DESCRIPTION OF THE DRAWINGS

FIG. 1 is an ocean elevation view of the present cylindrical object recovery apparatus wherein a torpedo is retained for recovery by personnel on a surface ship.

FIG. 2 is a side view of the cylindrical object recovery apparatus in a releasing position.

FIG. 3 is an end view of the cylindrical object recovery apparatus taken along plane IV—IV of FIG. 2.

FIG. 4 is a side view of the cylindrical object recovery apparatus in a grabbing position.

DESCRIPTION OF THE PREFERRED EMBODIMENT

Figure 5:
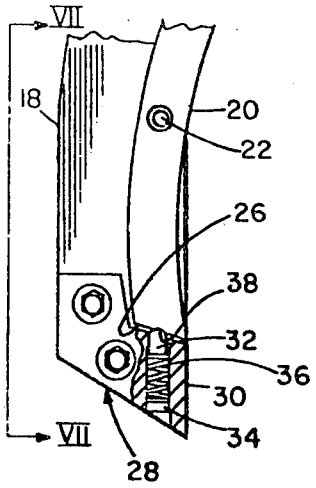
FIG. 5 is an enlarged side view of a bottom portion of one of the legs of the recovery apparatus with a portion cut away to show a locking device locking a pad in a releasing position.

Referring now to the drawings wherein like reference numerals designate like or similar parts throughout the several views, there is illustrated in FIG. 1 a cylindrical object recovery apparatus 10 which has been operated to grab a torpedo 12 on the floor of the ocean for recovery by personnel on a surface ship 14. A line 16 may be connected to the recovery apparatus 10 in order to raise the torpedo 12 to the surface ship.

Grabbing Mechanism

As illustrated in FIG. 2, the cylindrical object recovery apparatus 10 includes a U-shaped frame 18 which is curved substantially 180°. Curved pad means, which may include a pair of elongated curved pads 20, may be pivoted at 22 to a lower extremity of each respective leg of the U-shaped frame. The inside of the curves of each pad 20 face inwardly with respect to the U-shaped frame for movement between grabbing and releasing positions with respect to the cylindrical object (see FIGS. 2 and 4, respectively). As illustrated in FIG. 2, a top portion 24 of each pad extends slightly into the open area within the frame so as to be in position for forcible engagement with a top portion of the cylindrical object in the releasing position, and, as illustrated in FIG. 4, a bottom portion 26 of each pad extends the curve of the respective leg beyond the 180° of the frame so as to engage a bottom portion of the cylindrical object for retention purposes in the grabbing position. The pad 20 of each pair of pads is located one on each side of a respective leg as illustrated in FIG. 3. In order to optimize the grabbing operation of the cylindrical object it is preferred that each pad be pivoted to the respective leg midway between the ends of the pad. The operation is further optimized by making the inside circumference of each pad and the U-shaped frame 18 circular with substantially the same diameter as the cylindrical object which is to be recovered. It is also important for optimum operation that the pivot points 22 on the pair of legs of the U-shaped frame define the bottommost diametrical axis of the frame. With this arrangement the insertion of the recovery apparatus 10 over the cylindrical object causes the pads to gradually encompass the bottom of the object as the recovery apparatus is inserted downwardly thereon.

Figure 6:
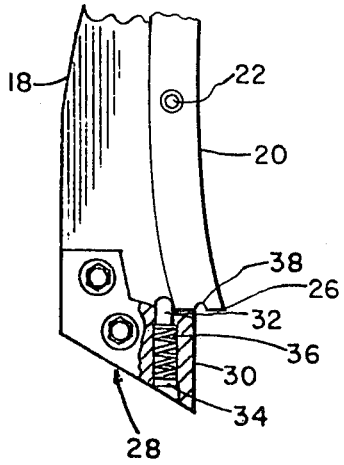
FIG. 6 is the same as FIG. 5 except the locking device is shown locking the pad in a grabbing position.
Figure 7:
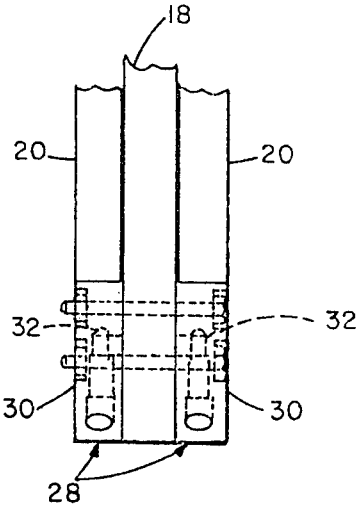
FIG. 7 is a view taken along plane VI—VI of FIG. 5.

Locking means, which may include a pair of locking devices 28, are mounted to each leg of the frame for locking a respective pad means alternately in its releasing position (see FIGS. 2 and 5) or its grabbing position (see FIGS. 4 and 6). The locking devices are responsive to forcible engagement with the cylindrical object to change the locking devices from a locked released position of the pads (see FIGS. 2 and 5) to a locked grabbing position of the pads (see FIGS. 4 and 6). In the preferred embodiment each locking means includes a pair of locking devices 28, as illustrated in FIG. 7, for operation on the bottom portion of each pair of pads 20.

As illustrated in FIGS. 2–7, each locking device 28 may include each leg of the U-shaped frame 18 having a bottom portion 30 which is located below the bottom end 26 of each respective pad 20. Each locking device may include a spring biased pin means which is mounted in each respective bottom portion of each leg. As shown in FIGS. 5 and 6 the spring biased pin means may include a rounded pin flange combination 32, a threaded plug 34, and a compression spring 36. Each pin 32 is slidably mounted in the bottom leg portion 30 for up and down reciprocatory movement for alternate engagement and disengagement within a respective rounded recess 38 of a respective bottom portion 26 of a pad. The plug 34 is threaded in the bottom of the bottom leg portion 30, and the spring 36 is located between the plug 34 and the pin 32 for spring biasing the pin 32 into locking engagement within the recess 38 of the respective pad 20.

It is important that the spring force of each spring 36, and the roundness of the pin 32 and the recess 38 be designed such that force on the top portion 24 of the pads by the cylindrical object pushes the bottom portion of each pad free of the respective pin 32 so that the bottom portions of the pads will encompass the cylindrical object in the positions illustrated in FIG. 4. When this happens each pin will snap up because of the force of the respective spring 36 on the outside of the bottom portion of each respective pad 20 so as to retain each pad in the grabbing position of the cylindrical object (see FIGS. 4 and 6). The pads can be returned to their releasing positions, as illustrated in FIG. 2, after recovery of the cylindrical object by merely unscrewing each plug 34 and allowing the respective pin 32 to be lowered so that the pad can be put in position for receiving the pin 32. The plug 34 is then threaded back into place.

In order to utilize the line 16 in FIG. 1 for lifting a cylindrical object, such as the torpedo 12, a lifting ARM 40 is provided, as illustrated in FIGS. 2, 3 and 4. The lifting arm 40 may be a U-shaped bracket which is pivoted to one of the legs of the U-shaped frame 18 mutually with respect to one of the pad means, such as at 22 on the left leg of the frame. As shown in the figures the lifting arm 40 extends beyond the outside of the U-shaped frame so as to be in position for receiving the lifting line 16. It should be noted that when line 16 applies a lifting force that the line of force will be directed substantially through the center of the cross section of the cylindrical object retained within the recovery apparatus. This will be important to maintain lateral balance of the cylindrical object as it is lifted to the surface ship 14.

Release Mechanism

Cooperating with the grabbing mechanism described hereinabove is a release mechanism which is shown generally at 50 in FIGS. 2, 3, 4 and 8–10. The release mechanism 50 can be utilized for releasably attaching the recovery apparatus 10 to a deployment vehicle such as a manned or remotely operated underwater vehicle. The release mechanism 50 cooperates with the grabbing apparatus described hereinabove by effecting a release from the deploying vehicle simultaneously with the grabbing mechanism retaining the cylindrical object for lifting purposes.

As illustrated in the figures the release mechanism includes a block 52 which may be U-shaped. The U-shaped block 52 is configured to fit over the center of the U-shaped frame 18, and to extend outside thereof beyond the intersection of the legs for containing structural elements to be described hereinbelow. The legs of the U-shaped block may be attached to the center portion of the U-shaped frame by bolt and nut combinations 54.

Figure 8:
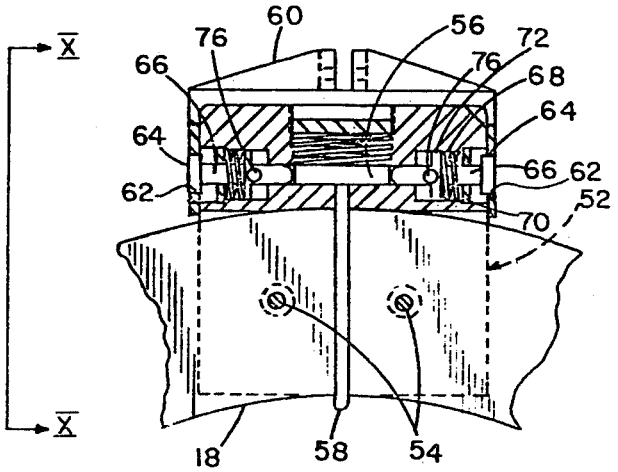
FIG. 8 is an enlarged side view of a top portion of the recovery apparatus with portions broken away to illustrate the release mechanism retaining the recovery apparatus to a holder.
Figure 9:
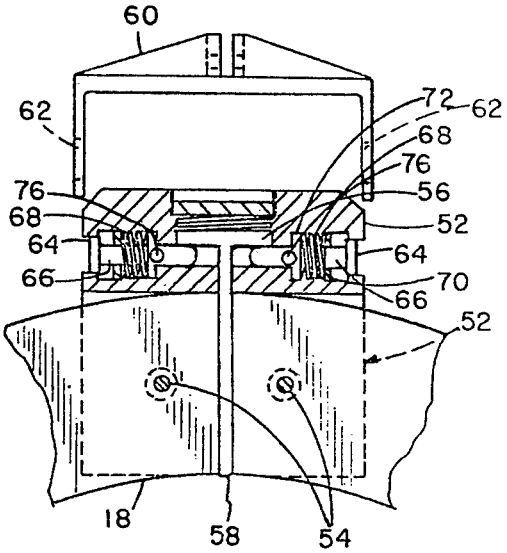
FIG. 9 is the same as FIG. 8 except the release mechanism is shown having released the holder from the recovery apparatus.
Figure 10:
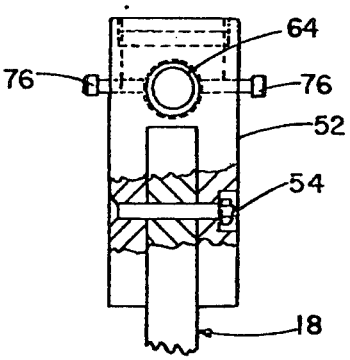
FIG. 10 is a view taken along plane VIII—VIII of FIG. 7 with a portion broken away to show a detail thereof.

As best illustrated in FIGS. 8 and 9, a piston 56 is slidably mounted in the outward extension of the block 52, and is movable vertically between down and up positions, as illustrated in FIGS. 8 and 9, respectively. At least one rod, and preferably a pair of rods 58, are connected to the piston 56 and extend vertically downwardly therefrom beyond the bottom of the top portion of the U-shaped frame 18 so as to be capable of moving the piston 56 to its upward position when forcibly engaged by the cylindrical object. It is important that the projection of the rods 58 below the top portion of the frame member be designed in length so as to cause the piston to go to its upward position when the pads 20 have gone to their grabbing positions, as illustrated in FIG. 4. This is what causes the simultaneous operation of the grabbing and release mechanisms.

As illustrated in FIGS. 2–4 and 8–9 a holder 60 is provided for releasable attachment to the block 52. The holder 60 is preferably U-shaped and is fitted over the block 52 in a 90° relationship. Each leg of the holder has a recess or aperture 62 which is adjacent a respective side of the top portion of the block. It is this holder 60 which will be released from the block 52 so as to separate a deploying vehicle from the recovery apparatus 18. The holder may be retained by the deploying vehicle by any suitable means, such as bolt and nut combinations (not shown) through holes 63 (see FIG. 3).

As best illustrated in FIGS. 8 and 9 a pair of pistons 64 is laterally mounted in the U-shaped block 52 in an opposing relationship and are movable between outward and inward positions. Each piston 64 is engageable within the holder 60 within a respective recess 62 in the outward position (see FIG. 8) for retaining the U-shaped holder 60 to the block 52, and each piston 64 will clear a respective recess 62 in its inward position so as to release the U-shaped holder 60 from the block 52 (see FIG. 9).

A rod 66 is connected to each lateral piston 64 and extends inwardly within the block 52 for engagement and disengagement with the edge of the vertical piston 56 as the vertical piston moves from its down position to its up position, respectively (see FIGS. 8 and 9, respectively). A compression spring 68 may be provided within each block for biasing the respective lateral piston 64 toward the inward position. This may be accomplished by positioning each spring 68 between a plug 70 threaded into the block and a flange 72 which is integral with the piston rod 66. With this arrangement the spring 68 will push on the flange 72 to push the rod inwardly.

It is important that each rod 66 maintain the respective lateral piston 64 in its outward holder engaging position when the lateral piston rod 66 is in engagement with the edge of the vertical piston 56 (as shown in FIGS. 2 and 8), and allow the lateral piston 64 to be spring biased to its inward disengaged position with respect to the holder when the lateral piston rod is disengaged from the vertical piston 56 (see FIGS. 4 and 9).

With the above arrangement the bottom of the vertical rod 58 will move upwardly when it is forcibly engaged by a cylindrical object. Likewise the vertical piston 56 moves upwardly and allows the lateral pistons 64 to move inwardly to release the U-shaped holder 60 from the block 52 and the remainder of the recovery apparatus 18. As stated hereinabove, this release will be simultaneous with the grabbing operation of the pads 20.

In order to cock the release mechanism, the block 52 is provided with slots 74 (see FIGS. 2 and 4) which extend parallel to the lateral piston rods 66. At least one pin and preferably a pair of pins 76 are fixed to each lateral piston rod 66 and extend perpendicularly therefrom through a respective slot beyond the block 52. With this arrangement the pins 76 can be hand operated to pull the pistons 64 to their outward positions so that the vertical piston 56 can be allowed to spring to its down position for maintaining the pistons 64 in their outward positions. In this mode the U-shaped holder is retained to the block 52.

Obviously many modifications and variations of the present invention are possible in the light of the above teachings. It is therefore to be understood that within the scope of the appended claims the invention may be practiced otherwise than as specifically described.

What is claimed is:

1. A release mechanism for a structural member which has top and bottom sides comprising:

a block which is attachable to the structural member so as to extend thereabove;

a piston mounted in the block and movable vertically between up and down positions;

at least one rod connected to the piston and extending vertically downwardly beyond the bottom side of the structural member so as to be capable of moving the piston to the upward position when forcibly engaged by the object;

a U-shaped holder fitted over the block with each leg of the holder having a recess;

a pair of pistons laterally mounted in the U-shaped block in an opposing relationship and movable between inward and outward positions, the pistons being engageable with the holder within the recesses in the outward positions for retaining the U-shaped holder to the block, and clearing the recesses in the inward positions to release the U-shaped holder from the block;

a rod connected to each lateral piston and extending inwardly for engagement and disengagement with the edge of the vertical piston as the vertical piston moves from its down position to its up position, respectively;

means spring biasing the lateral pistons toward the inward positions; and each rod maintaining the respective lateral piston in its outward holder engaging position when the lateral piston rod is in engagement with the vertical piston, and allowing the lateral piston to be spring biased to its inward disengaged position with respect to the holder when the lateral piston rod is disengaged from the vertical piston;

whereby upon the object forcibly engaging the bottom of the vertical rod the vertical piston will move upwardly to allow the lateral pistons to move inwardly and release the U-shaped holder from the block and the structural member.

2. A release mechanism as claimed in claim 1 including:

means spring biasing the vertical piston toward the downward position.

3. A release mechanism as claimed in claim 1 including:

the block having slots which extend parallel to the lateral piston rods; and a pin affixed to each lateral piston rod and extending perpendicularly therefrom through a respective slot beyond the block for cocking the respective lateral piston in its outward position.

4. A release mechanism as claimed in claim 1 including:

the block being U-shaped; and the U-shaped holder fitting over the U-shaped block in a 90° relationship.

5. A release mechanism as claimed in claim 4 for a U-shaped structural member, the mechanism including:

the U-shaped block being configured to fit over the center of the U-shaped structural member and extend outside thereof beyond the intersection of the legs of the U-shaped structural member; and the vertical piston rod being extendable into the area within the U-shaped structural member.

6. A release mechanism as claimed in claim 5 including:

a pair of vertical piston rods, one on each side of the structural member.

7. A release mechanism as claimed in claim 6 including:

means spring biasing the vertical piston toward the downward position.

8. A release mechanism as claimed in claim 7 including:

the block having slots which extend parallel to the lateral piston rods; and a pin affixed to each lateral piston rod and extending perpendicularly therefrom through a respective slot beyond the block for cocking the respective lateral piston in its outward position.

* * * * *